US005835013A

United States Patent [19]

Duterte

[11] Patent Number: 5,835,013

[45] Date of Patent: Nov. 10, 1998

[54] WIRELESS PURSE-SNATCHER/LUGGAGE ALARM

[76] Inventor: Fred V. Duterte, P.O. Box 5507, Pleasanton, Calif. 94566

[21] Appl. No.: 960,972

[22] Filed: Oct. 30, 1997

[51] Int. Cl.[6] ..... G08B 1/08

[52] U.S. Cl. ..... 340/539; 340/571; 340/574

[58] Field of Search ..... 340/539, 541, 340/571, 572, 573, 574

[56] References Cited

U.S. PATENT DOCUMENTS

| | | | |
|---|---|---|---|
| 4,591,835 | 5/1986 | Sharp | 340/539 |
| 4,808,943 | 2/1989 | Soleimani | 340/572 |
| 5,001,460 | 3/1991 | Basson | 340/571 |
| 5,043,702 | 8/1991 | Kuo | 340/539 |
| 5,223,815 | 6/1993 | Rosenthal et al. | 340/539 |
| 5,530,426 | 6/1996 | Milk | 340/539 |
| 5,652,569 | 7/1997 | Gerstenberger et al. | 340/539 |

*Primary Examiner*—Jeffrey A. Hofsass
*Assistant Examiner*—Van T. Trieu

[57] ABSTRACT

A baggage proximity monitor is provided including a portable user housing adapted to be carried by a user and a baggage housing including a mounting mechanism for releasably mounting to an article of baggage. Next provided is a user circuit including a transmitter adapted to continuously transmit an activation signal of a predetermined magnitude and at a predetermined frequency only upon the actuation thereof and a switch situated on the housing and connected to the transmitter. The switch has a first orientation for actuating the transmitter and second orientation for precluding the actuation thereof. Also included is baggage circuit including a receiver mechanism for receiving the activation signal only at the predetermined frequency via free space, a comparator mechanism connected to the receiver mechanism and adapted to transmit the activation signal only upon a magnitude of the activation signal being below a predetermined amount, and an audio mechanism connected to the comparator mechanism for emitting an audio when the activation signal is received.

6 Claims, 3 Drawing Sheets

FIG. 3
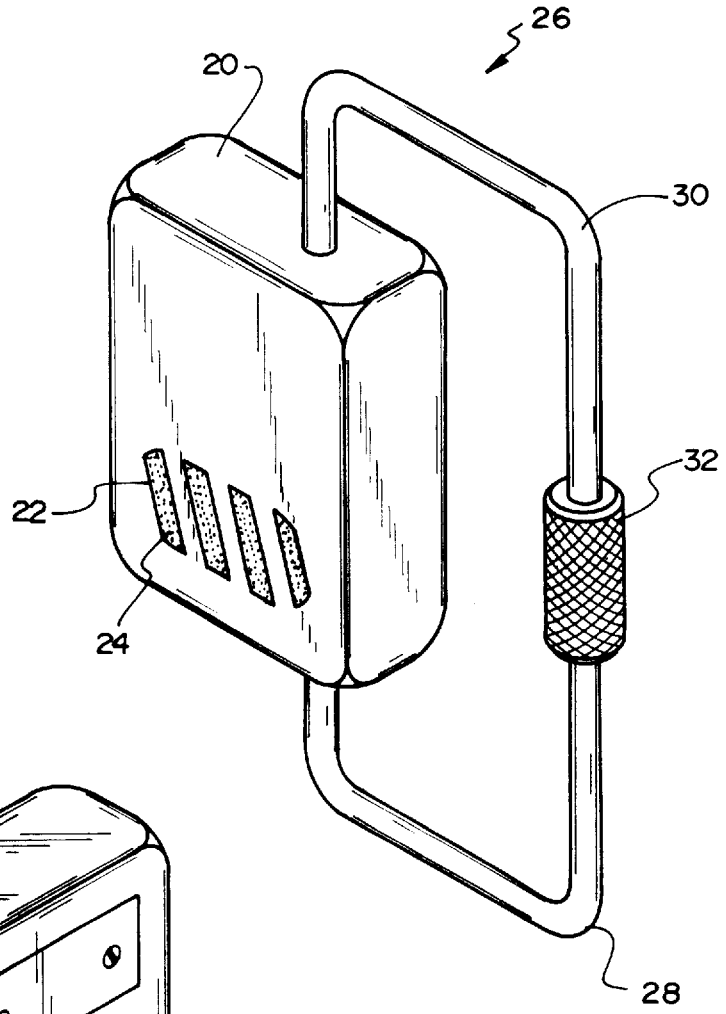
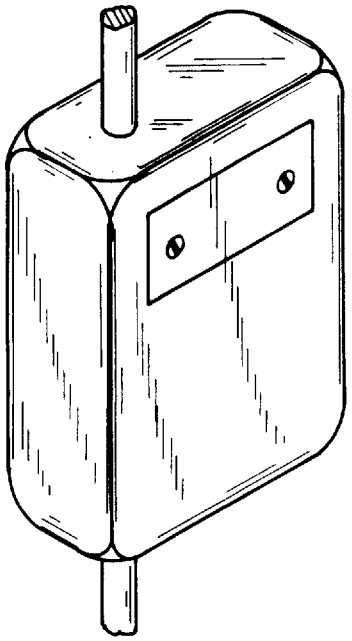
FIG. 4

WIRELESS PURSE-SNATCHER/LUGGAGE ALARM

BACKGROUND OF THE INVENTION

1. Field of the Invention

The present invention relates to distance monitors and more particularly pertains to a new wireless purse-snatcher/luggage alarm for preventing the theft of an article of baggage or a purse.

2. Description of the Prior Art

The use of distance monitors is known in the prior art. More specifically, distance monitors heretofore devised and utilized are known to consist basically of familiar, expected and obvious structural configurations, notwithstanding the myriad of designs encompassed by the crowded prior art which have been developed for the fulfillment of countless objectives and requirements.

Known prior art distance monitors include U.S. Pat. No. 4,584,571; U.S. Pat. No. 4,052,718; U.S. Pat. No. 4,899,135; U.S. Pat. No. 4,785,291; U.S. Pat. No. 4,772,878; and U.S. Pat. No. Des. 345,116.

In these respects, the wireless purse-snatcher/luggage alarm according to the present invention substantially departs from the conventional concepts and designs of the prior art, and in so doing provides an apparatus primarily developed for the purpose of preventing the theft of an article of baggage or a purse.

SUMMARY OF THE INVENTION

In view of the foregoing disadvantages inherent in the known types of distance monitors now present in the prior art, the present invention provides a new wireless purse-snatcher/luggage alarm construction wherein the same can be utilized for preventing the theft of an article of baggage or a purse.

The general purpose of the present invention, which will be described subsequently in greater detail, is to provide a new wireless purse-snatcher/luggage alarm apparatus and method which has many of the advantages of the distance monitors mentioned heretofore and many novel features that result in a new wireless purse-snatcher/luggage alarm which is not anticipated, rendered obvious, suggested, or even implied by any of the prior art distance monitors, either alone or in any combination thereof.

To attain this, the present invention generally comprises a portable user housing having a rectilinear configuration. As shown in FIGS. 1 & 2, the user housing is defined by a front face, a rear face, a top face, a bottom face, and a pair of side faces forming an interior space. For mounting the housing to an article of clothing of a user, the rear face of the user housing has a clip formed thereon. With reference now to FIGS. 3 & 4, it is shown that a baggage housing is provided. Similar to the user housing, the baggage housing has a rectilinear configuration with a front face, a rear face, a top face, a bottom face, and a pair of side faces defining an interior space. For reasons that will become apparent hereinafter, the front face of the housing has a grill formed therein. The baggage housing further includes a mounting means with a bottom portion having a U-shaped configuration. The bottom portion has a first end thereof fixedly coupled to the bottom face of the baggage housing in perpendicular relationship therewith. A second end of the bottom portion has a plurality of threads formed thereon. The mounting means also includes a top portion having an inverted U-shaped configuration with a first end thereof rotatably coupled to the top face of the baggage housing in perpendicular relationship therewith. The top portion further has a second end having a sleeve slidably and rotatably coupled thereto in linear alignment therewith. The sleeve has a knurled outer surface and a threaded inner surface. By this structure, the sleeve is adapted for releasably engaging the second end of the bottom portion of the mounting means and defining a closed loop for coupling with an article of baggage. A user circuit is situated within the user housing, as shown in FIG. 5. The user circuit includes a transmitter adapted to continuously transmit an activation signal of a predetermined magnitude and at a predetermined frequency only upon the actuation thereof. Associated therewith is a toggle switch situated on the front face of the user housing and connected to the transmitter. During use, the toggle switch has a first orientation for actuating the transmitter and second orientation for precluding the actuation thereof. For indicating whether the transmitter is actuated, a light emitting diode is positioned on the top face of the user housing and connected to the toggle switch. The diode is thus adapted for illuminating only when the toggle switch is in the first orientation thereof. Next provided is a baggage circuit situated within the baggage housing. As shown in FIG. 6, the baggage circuit includes a receiver means for receiving the activation signal only at the predetermined frequency via free space. Comparator means is connected to the receiver means and adapted to transmit the activation signal only upon a magnitude of the activation signal being below a predetermined amount. Lastly, audio means is connected to the comparator means for emitting an audio tone from the grill of the baggage housing when the activation signal is received.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wireless purse-snatcher/luggage alarm apparatus and method which has many of the advantages of the distance monitors mentioned heretofore and many novel features that result in a new Wireless purse-snatcher/luggage alarm which is not anticipated, rendered obvious, suggested, or even implied by any of the prior art distance monitors, either alone or in any combination thereof.

It is another object of the present invention to provide a new Wireless purse-snatcher/luggage alarm which may be easily and efficiently manufactured and marketed.

It is a further object of the present invention to provide a new wireless purse-snatcher/luggage alarm which is of a durable and reliable construction.

An even further object of the present invention is to provide a new wireless purse-snatcher/luggage alarm which is susceptible of a low cost of manufacture with regard to both materials and labor, and which accordingly is then susceptible of low prices of sale to the consuming public, thereby making such wireless purse-snatcher/luggage alarm economically available to the buying public.

Still yet another object of the present invention is to provide a new wireless purse-snatcher/luggage alarm which provides in the apparatuses and methods of the prior art some of the advantages thereof, while simultaneously overcoming some of the disadvantages normally associated therewith.

Still another object of the present invention is to provide a new wireless purse-snatcher/luggage alarm for preventing the theft of an article of baggage or a purse.

Even still another object of the present invention is to provide a new wireless purse-snatcher/luggage alarm that includes a portable user housing adapted to be carried by a user and a baggage housing including a mounting mechanism for releasably mounting to an article of baggage. Next provided is a user circuit including a transmitter adapted to continuously transmit an activation signal of a predetermined magnitude and at a predetermined frequency only upon the actuation thereof and a switch situated on the housing and connected to the transmitter. The switch has a first orientation for actuating the transmitter and second orientation for precluding the actuation thereof. Also included is baggage circuit including a receiver mechanism for receiving the activation signal only at the predetermined frequency via free space, a comparator mechanism connected to the receiver mechanism and adapted to transmit the activation signal only upon a magnitude of the activation signal being below a predetermined amount, and an audio mechanism connected to the comparator mechanism for emitting an audio when the activation signal is received.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front perspective view of the baggage housing of the present invention.

FIG. 4 is a rear perspective view of the baggage housing of the present invention.

DESCRIPTION OF THE PREFERRED EMBODIMENT

Figure 1:
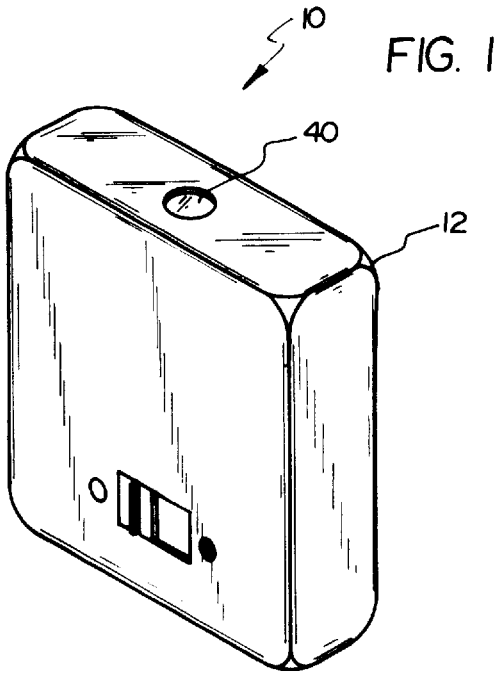
FIG. 1 is a front perspective view of the user housing of the present invention.

With reference now to the drawings, and in particular to FIGS. 1 through 6 thereof, a new Wireless purse-snatcher/luggage alarm embodying the principles and concepts of the present invention and generally designated by the reference numeral 10 will be described.

Figure 2:
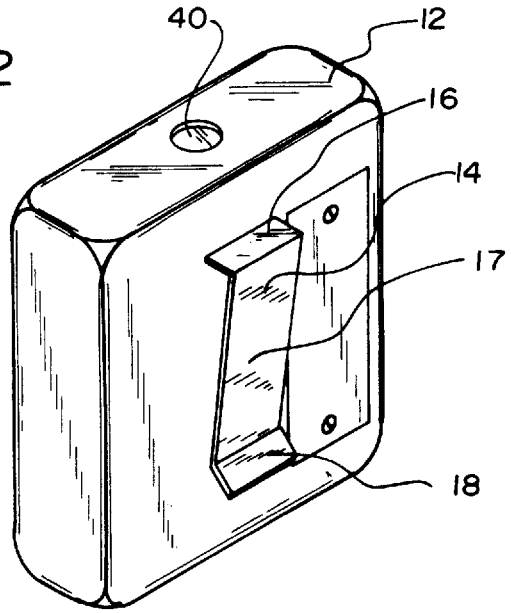
FIG. 2 is a rear perspective view of the user housing of the present invention.

The system designated as numeral 10 includes a portable user housing 12 having a rectilinear configuration. As shown in FIGS. 1 & 2, the user housing is defined by a front face, a rear face, a top face, a bottom face, and a pair of side faces forming an interior space. For mounting the housing to an article of clothing of a user, the rear face of the user housing has a clip 14 formed thereon. As shown, the clip has a top horizontal tab 16 from which a elongated member 17 depends downwardly and inwardly toward the rear face of the user housing at an end of which an upturned portion 18 is formed. It should be understood that various other types of coupling means may be employed to facilitate the carrying of the user housing.

With reference now to FIGS. 3 & 4, it is shown that a baggage housing 20 is provided. Similar to the user housing, the baggage housing has a rectilinear configuration with a front face, a rear face, a top face, a bottom face, and a pair of side faces defining an interior space. For reasons that will become apparent hereinafter, the front face of the housing has a grill 22 formed therein. A waterproof 24 covering is preferably situated over the grill.

The baggage housing further includes a mounting means 26 with a bottom portion 28 having a U-shaped configuration. The bottom portion has a first end thereof fixedly coupled to the bottom face of the baggage housing in perpendicular relationship therewith. A second end of the bottom portion has a plurality of unillustrated threads formed thereon. The mounting means also includes a top portion 30 having an inverted U-shaped configuration with a first end thereof rotatably coupled to the top face of the baggage housing in perpendicular relationship therewith. The top portion further has a second end having a sleeve 32 slidably and rotatably coupled thereto in linear alignment therewith. The sleeve has a knurled outer surface and a threaded inner surface. By this structure, the sleeve is adapted for releasably engaging the second end of the bottom portion of the mounting means and defining a closed loop for coupling with an article of baggage. It should be noted that when the second ends of the portions are secured, the mounting means resides in a plane common with that of the housing. Similar to the user housing, various other types of alternate coupling mechanisms such as straps, belts, screws and the like may be utilized to attach the baggage housing to a recipient surface. Further, in the present description, the term baggage is meant to include any carried storage entity such as a purse, briefcase and the like.

Figure 5:
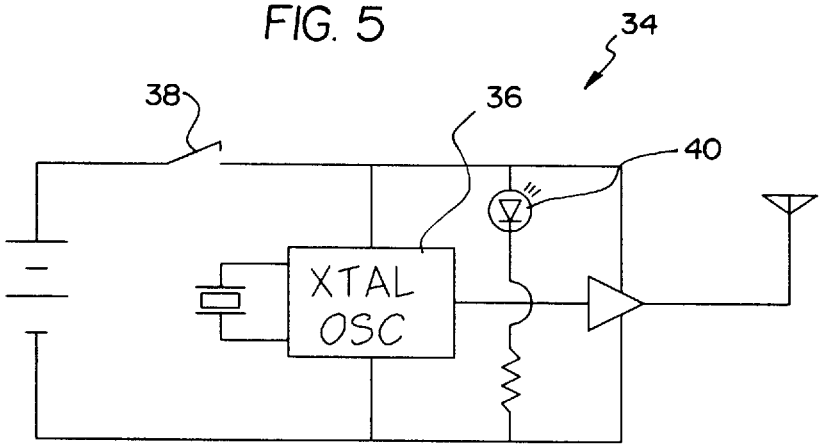
FIG. 5 is a schematic diagram of the user circuit of the present invention.

A user circuit 34 is situated within the user housing, as shown in FIG. 5. The user circuit includes a transmitter 36 adapted to continuously transmit an activation signal of a predetermined magnitude and at a predetermined frequency only upon the actuation thereof. It should be noted that such magnitude abates as a function of distance from the user housing. Such magnitude thus is selected such that it is of a predetermined amount when a distance between the user housing and an article of baggage reaches a point at which a user wishes to be alerted.

Associated therewith is a toggle switch 38, or slide switch, situated on the front face of the user housing and connected to the transmitter. During use, the toggle switch has a first orientation for actuating the transmitter and second orientation for precluding the actuation thereof. For indicating whether the transmitter is actuated, a light emitting diode 40 is positioned on the top face of the user housing and connected to the toggle switch. The diode is thus adapted for illuminating only when the toggle switch is in the first orientation thereof.

Figure 6:
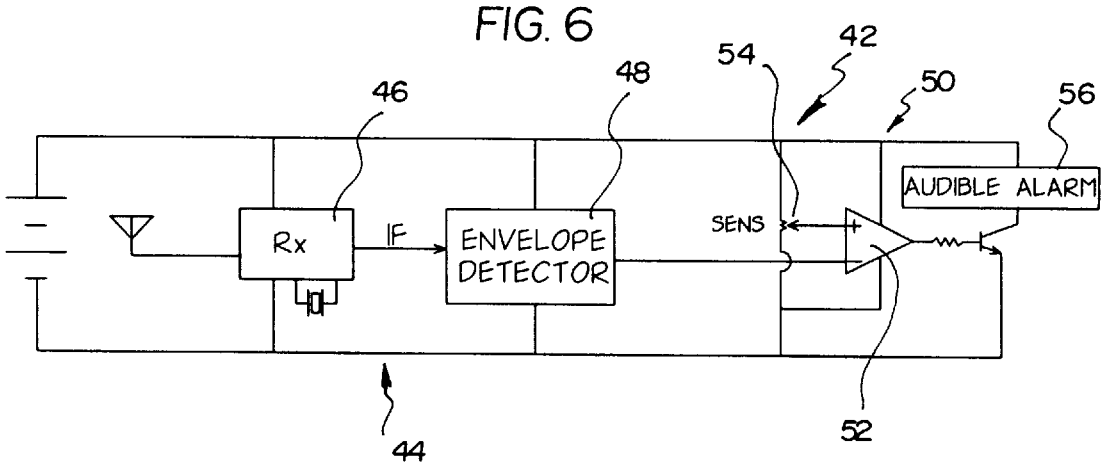
FIG. 6 is a schematic diagram of the baggage circuit of the present invention.

Next provided is a baggage circuit 42 situated within the baggage housing. As shown in FIG. 6, the baggage circuit includes a receiver means 44 for receiving the activation signal only at the predetermined frequency via free space. The receiver means includes a receiver 46 and an envelope detector 48 that is adapted to generate an activation signal with a constant magnitude equal to that of the activation signal received by the receiver.

Comparator means 50 is connected to the receiver means and adapted to transmit the activation signal only upon a magnitude of the activation signal being below a predetermined amount. To accomplish this, a negative input of an operational amplifier 52 is connected to the envelope detector and a positive input is connected to a voltage divider. As an option, such voltage divider may comprise a potentiometer 54 so as to allow the user to select the predetermined amount the magnitude below which the present invention is actuated. Such potentiometer preferably takes the form of a switch mounted on the baggage housing. The present slide switch has a first orientation and a second orientation for effecting the transmission of the activation signal by the comparator means only upon a magnitude of the activation signal being below a first predetermined amount corresponding to a first distance from the user housing and a second predetermined amount corresponding to a second distance therefrom, respectively. Such respective distances are 25 feet and 10 feet. In other words, by equipping the baggage circuit with a potentiometer which is controlled by a switch on the baggage housing, the user may select the distance from the user housing the baggage housing must be before the present invention is actuated.

Lastly, an audio means 56 is connected to the comparator means for emitting an audio tone from the grill of the baggage housing when the activation signal is received. In the preferred embodiment, a hidden slide switch is situated in the battery compartment which has a first orientation and a second orientation for effecting the emission of an audio tone at a first level of magnitude and a second higher level of magnitude, respectively. Such levels are preferably 50–60 dB and 100 dB, respectively. It should be noted that in an alternate use, the present invention may be employed as a child monitor.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baggage proximity monitor comprising, in combination:

a portable user housing having a rectilinear configuration with a front face, a rear face, a top face, a bottom face, and a pair of side faces defining an interior space, the rear face having a clip formed thereon for mounting the housing to an article of clothing of a user;

a baggage housing having a rectilinear configuration with a front face, a rear face, a top face, a bottom face, and a pair of side faces defining an interior space, the front face of the housing having a grill formed therein, the baggage housing further including a mounting means including a bottom portion having a U-shaped configuration with a first end thereof fixedly coupled to the bottom face of the baggage housing in perpendicular relationship therewith and a second end thereof having a plurality of threads formed thereon, the mounting means also including a top portion having an inverted U-shaped configuration with a first end thereof rotatably coupled to the top face of the baggage housing in perpendicular relationship therewith and a second end thereof having a sleeve slidably and rotatably coupled thereto in linear alignment therewith, the sleeve having a knurled outer surface and a threaded inner surface for releasably engaging the second end of the bottom portion of the mounting means for defining a closed loop for coupling with an article of baggage;

a user circuit situated within the user housing, the user circuit including:

a transmitter adapted to continuously transmit an activation signal of a predetermined magnitude and at a predetermined frequency only upon the actuation thereof, a toggle switch situated on the front face of the user housing and connected to the transmitter, the toggle switch having a first orientation for actuating the transmitter and second orientation for precluding the actuation thereof, and a light emitting diode situated on the top face of the user housing and connected to the toggle switch for illuminating only when the toggle switch is in the first orientation thereof; and a baggage circuit situated within the baggage housing, the baggage circuit including:

receiver means for receiving the activation signal only at the predetermined frequency via free space, comparator means connected to the receiver means and adapted to transmit the activation signal only upon a magnitude of the activation signal being below a predetermined amount, and audio means connected to the comparator means for emitting an audio tone from the grill of the baggage housing when the activation signal is received.

2. A baggage proximity monitor comprising:

an article of baggage;

a portable user housing adapted to be carried by a user;

a baggage housing including a mounting means for releasably mounting to the article of baggage;

a first circuit situated within at least one of the user housing and the baggage housing, the first circuit including:

a transmitter adapted to continuously transmit an activation signal of a predetermined magnitude and at a predetermined frequency only upon the actuation thereof and a switch connected to the transmitter, the switch having a first orientation for actuating the transmitter and second orientation for precluding the actuation thereof; and a second circuit situated within at least one of the user housing and the baggage housing, the second circuit including:

receiver means for receiving the activation signal only at the predetermined frequency via free space, comparator means connected to the receiver means and adapted to transmit the activation signal only upon a magnitude of the activation signal being below a predetermined amount, and audio means connected to the comparator means for emitting an audio tone when the activation signal is received;

wherein the mounting means includes a bottom portion having a U-shaped configuration with a first end thereof fixedly coupled to a bottom face of the baggage housing in perpendicular relationship therewith and a second end thereof having a plurality of threads formed thereon, the mounting means also including a top portion having an inverted U-shaped configuration with a first end thereof rotatably coupled to a top face of the baggage housing in perpendicular relationship therewith and a second end thereof having a sleeve slidably and rotatable coupled thereto in linear alignment therewith, the sleeve having a knurled outer surface and a threaded inner surface for releasably engaging the second end of the bottom portion of the mounting means for defining a closed loop for coupling with the article of baggage.

3. A baggage proximity monitor as set forth in claim 2 wherein the user housing has a clip formed thereon.

4. A baggage proximity monitor as set forth in claim 2 wherein a light emitting diode is situated on the housing in which the first circuit is located and connected to the switch for illuminating only when the switch is in the first orientation thereof.

5. A baggage proximity monitor as set forth in claim 2 wherein the mounting means includes an openable closed loop.

6. A proximity monitor comprising a portable user housing adapted to be carried by a user;

an entity housing including a mounting means for releasably mounting to an entity;

a first circuit situated within at least one of the user housing and the entity housing, the first circuit including:

a transmitter adapted to continuously transmit an activation signal of a predetermined magnitude and at a predetermined frequency only upon the actuation thereof and a switch connected to the transmitter, the switch having a first orientation for actuating the transmitter and second orientation for precluding the actuation thereof; and a second circuit situated within at least one of the user housing and the entity housing, the second circuit including:

receiver means for receiving the activation signal only at the predetermined frequency via free space, comparator means connected to the receiver means and adapted to transmit the activation signal only upon a magnitude of the activation signal being below a predetermined amount, and audio means connected to the comparator means for emitting an audio tone when the activation signal is received wherein the mounting means includes a bottom portion having a U-shaped configuration with a first end thereof fixedly coupled to a bottom face of the housing in perpendicular relationship therewith and a second end thereof having a plurality of threads formed thereon, the mounting means also including a top portion having an inverted U-shaped configuration with a first end thereof rotatably coupled to a top face of the housing in perpendicular relationship therewith and a second end thereof having a sleeve slidably and rotatably coupled thereto in linear alignment therewith, the sleeve having a knurled outer surface and a threaded inner surface for releasably engaging the second end of the bottom portion of the mounting means for defining a closed loop for coupling with said entity.

* * * * *